US009234534B2

(12) United States Patent
Cyphelly

(10) Patent No.: US 9,234,534 B2
(45) Date of Patent: Jan. 12, 2016

(54) LIQUID PISTON ARRANGEMENT WITH PLATE EXCHANGER FOR THE QUASI-ISOTHERMAL COMPRESSION AND EXPANSION OF GASES

(71) Applicant: Ivan Cyphelly, Las Palmas de Gran Canaria (ES)

(72) Inventor: Ivan Cyphelly, Las Palmas de Gran Canaria (ES)

( * ) Notice: Subject to any disclaimer, the term of this patent is extended or adjusted under 35 U.S.C. 154(b) by 357 days.

(21) Appl. No.: 13/752,840

(22) Filed: Jan. 29, 2013

(65) Prior Publication Data

US 2013/0213213 A1 Aug. 22, 2013

(30) Foreign Application Priority Data

Feb. 20, 2012 (DE) ..... 10 2012 003 288

(51) Int. Cl.
*F15B 15/00* (2006.01)
*F04B 39/00* (2006.01)

(52) U.S. Cl.
CPC ..... *F15B 15/00* (2013.01); *F04B 39/0011* (2013.01)

(58) Field of Classification Search
CPC .. F04B 39/0011; F04B 39/062; F04B 53/141; F02G 2270/70
USPC ..... 60/517, 525, 407; 417/92
See application file for complete search history.

(56) References Cited

U.S. PATENT DOCUMENTS

| | | | | |
|---|---|---|---|---|
| 586,100 | A | 7/1897 | Knight | |
| 5,641,273 | A | 6/1997 | Moseley | |
| 7,802,426 | B2 | 9/2010 | Bollinger | |
| 2010/0133903 | A1 | 6/2010 | Rufer et al. | |
| 2010/0199652 | A1 * | 8/2010 | Lemofouet et al. | 60/407 |
| 2011/0023977 | A1 | 2/2011 | Fong et al. | |
| 2011/0061741 | A1 | 3/2011 | Ingersoll et al. | |
| 2011/0203267 | A1 * | 8/2011 | Ramming et al. | 60/517 |
| 2011/0258996 | A1 | 10/2011 | Ingersoll et al. | |

FOREIGN PATENT DOCUMENTS

| | | | |
|---|---|---|---|
| DE | 34 08 633 | A1 | 9/1985 |
| DE | 44 30 716 | A1 | 3/1996 |
| DE | 102008042828 | A1 * | 4/2010 |
| EP | 2 273 119 | B1 | 10/2011 |
| WO | 98/17492 | A1 | 4/1998 |
| WO | 00/70221 | A1 | 11/2000 |
| WO | 2009/034421 | A | 3/2009 |
| WO | 2010128224 | A1 | 11/2010 |
| WO | 2010128244 | A1 | 11/2010 |

OTHER PUBLICATIONS

International Search Report relating to PCT/EP2013/052946 dated Jul. 30, 2013.

International Search Report—PCT Filed Feb. 14, 2013; Mailed Apr. 5, 2013.

(Continued)

*Primary Examiner* — Thomas E Lazo

(74) *Attorney, Agent, or Firm* — Dinsmore & Shohl LLP

(57) ABSTRACT

The invention relates to a liquid piston arrangement for compressing and expanding gases. The liquid piston arrangement includes a liquid piston which is embodied by a liquid level formed by a liquid in a high-pressure space and a stack of sheets with mutually spaced apart sheet metal plates which is supported in the high-pressure space dipping in the liquid and is sequentially flowed around by the liquid.

20 Claims, 12 Drawing Sheets

(56) References Cited

OTHER PUBLICATIONS

Figure 1:
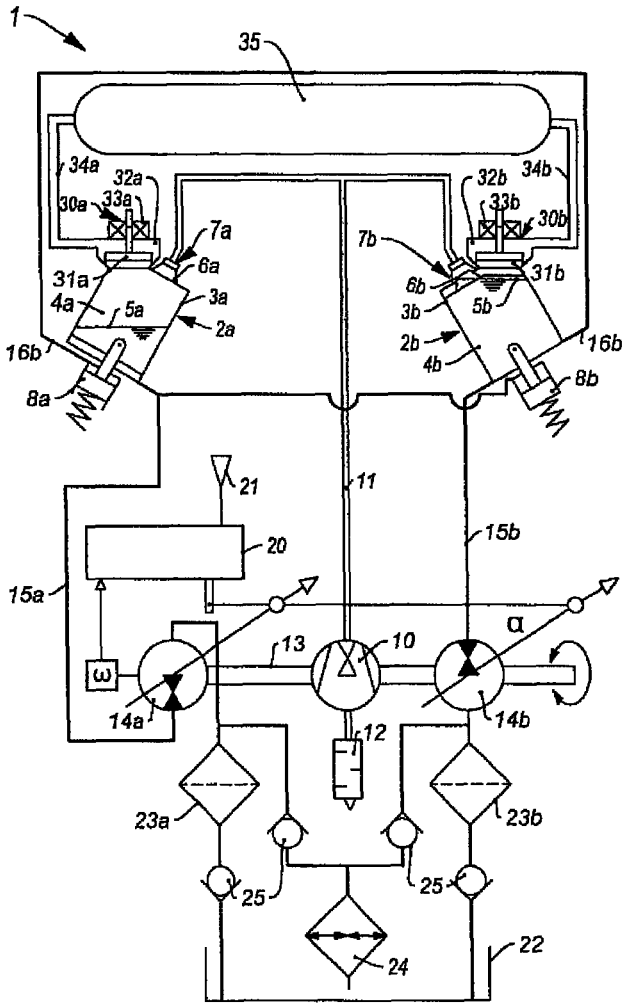

Einsatz von Druckluftspeichersystemen—May 2004; I. Cyphelly, A. Rufer, Ph. Bruckmann, W. Menhardt, A. Roller.
Druckluftspeicherung: Optimierung/Ausmessung bestehendes Projektmuster; Ivan Cyphelly, Philip Bruckmann.
Projekt Machbarkeit des Durckluftspeicherkonzeptes BOP-B—Dec. 27, 2004.
Projekt Machbarkeit des Druckluftspeicherkonzeptes BOP-B—Dec. 2, 2005.
Usage of Compressed Air Storage Systems; Final Report May 2004—I. Cyphelly, A. Rufer, Ph. Bruckmann, W. Menhardt, A. Reller.

* cited by examiner

LIQUID PISTON ARRANGEMENT WITH PLATE EXCHANGER FOR THE QUASI-ISOTHERMAL COMPRESSION AND EXPANSION OF GASES

CROSS-REFERENCE TO RELATED APPLICATIONS

This application claims priority of German Patent Application 102012003288.9 filed Feb. 20, 2012.

The invention relates to a liquid piston arrangement with a plate exchanger for the quasi-isothermal compression and expansion of gases.

High-pressure air storage has been known since the 19th century, but has only been able to establish itself in specific applications to date. In recent times, however, the interest in this technology has been increasing since ways are being looked for to utilize renewable energies in a decentralized arrangement and to support the existing power supplies with local storages.

High-pressure air storage utilizes the energy contained in compressed air. In times in which, for example, more electricity is produced than is consumed, air can be compressed into a storage under pressure using the excess energy. When electricity is required, the energy stored in the compressed air is again converted into other forms of energy, e.g. electrical current, or machines or directly driven vehicles.

Compression and expansion at higher pressure ranges (100 to 300 bar) remain processes which suffer from losses since the coupling between heating and pressure increase (or between cooling and pressure drop) prevents efficient operation and only adiabatic processes intercooled section-wise can be strung together. Multistage compressors having a plurality of valves and topologically induced dead spaces accordingly achieve energetic efficiencies which barely exceed 50%, and only with a substantial effort and/or cost such as with heat exchanges having high-pressure capability for every single stage. These low efficiencies make the technique of compression and expansion for the purpose of energy storage in high-pressure containers difficult.

To eliminate this problem, a heat exchange is necessary during the pressure change so that an approximately isothermal behavior can be enforced, and only combined with an elimination of dead spaces. Problem solutions are known in this respect which limit the temperature fluctuations thanks to a direct heat exchange by spray injection into screw compressors, scroll compressors or liquid piston compressors, with here the heat first being transferred to the drops and subsequently reaching an external exchanger. The return of the spray precipitation from the high-pressure area is, however, technically complex. In motor operation (expansion), an additional liquid circuit has to ensure the spraying which in turn has to be separated in the exhaust pipe to return into the circuit.

It is therefore the underlying object of the invention to provide a liquid piston arrangement for approximately isothermal processes in the higher pressure range.

The object underlying the invention is satisfied by the features of claim 1. Advantageous further developments and aspects of the invention are set forth in the dependent claims. A method of compressing and expanding gases is described in claim 16. Further advantageous liquid piston arrangements are furthermore named in claims 17, 18 and 20.

Figure 4:
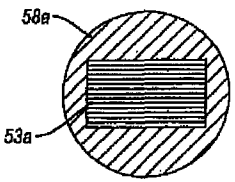
Figure 3A:
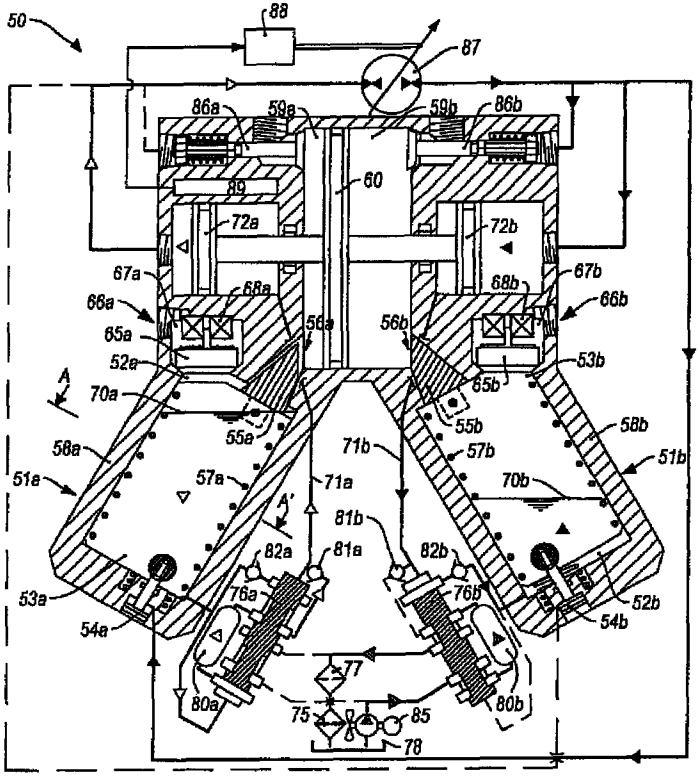
Figure 5:
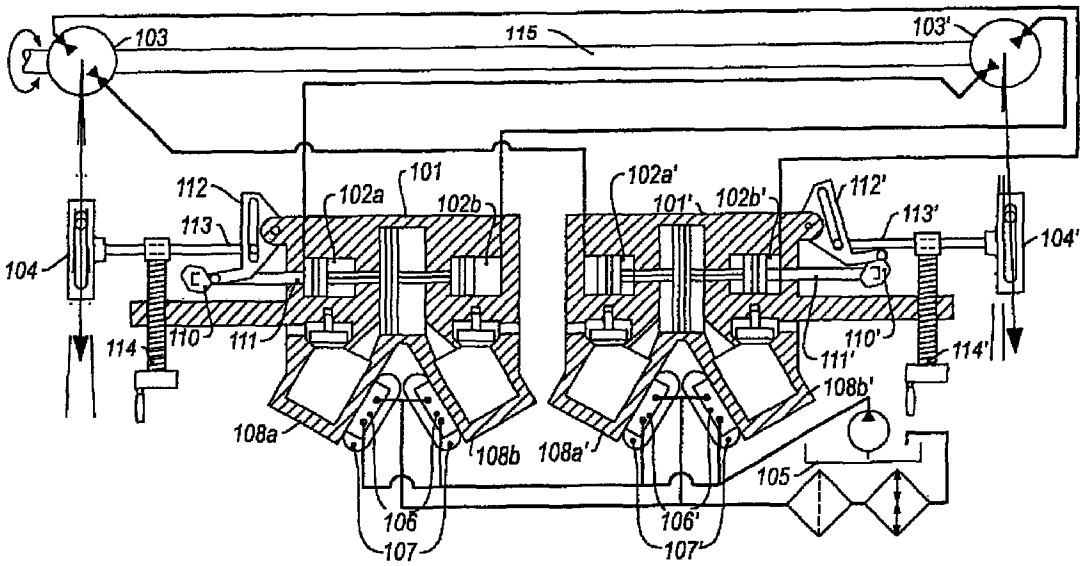
Figure 6:
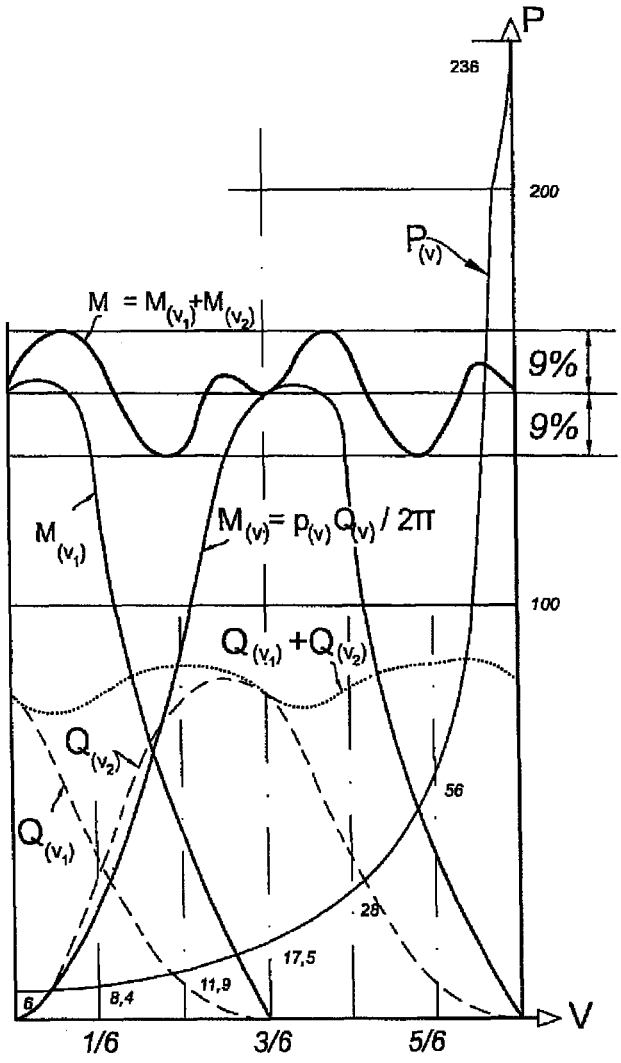
Figure 7B:
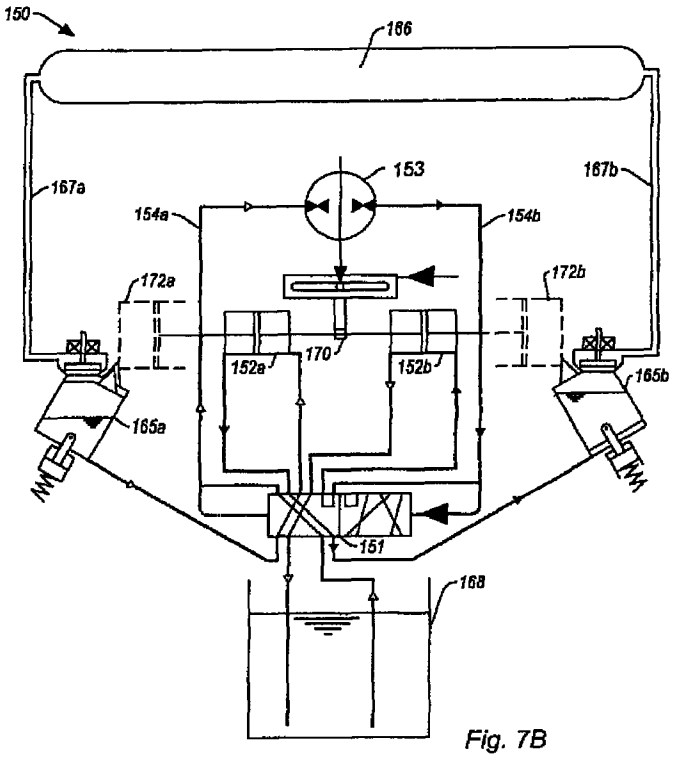
Figure 7A:
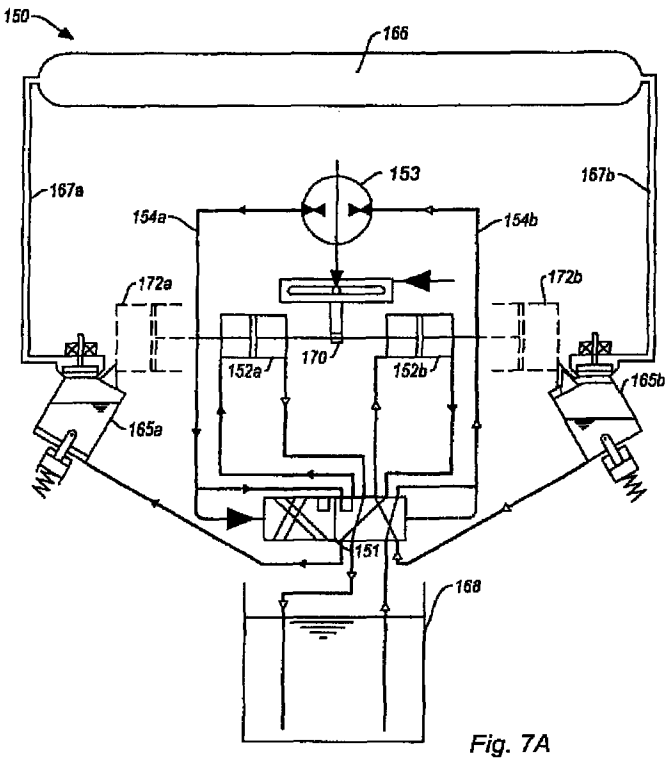
Figure 7D:
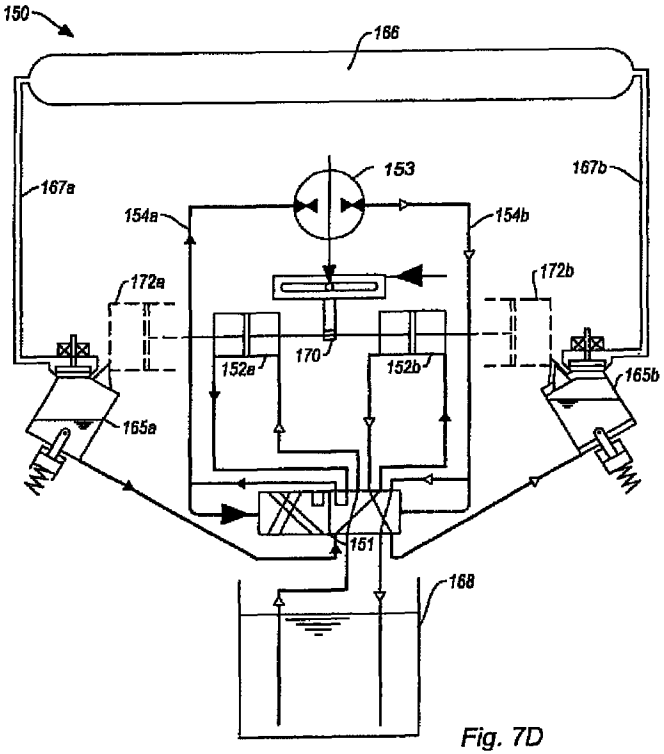
Figure 7C:
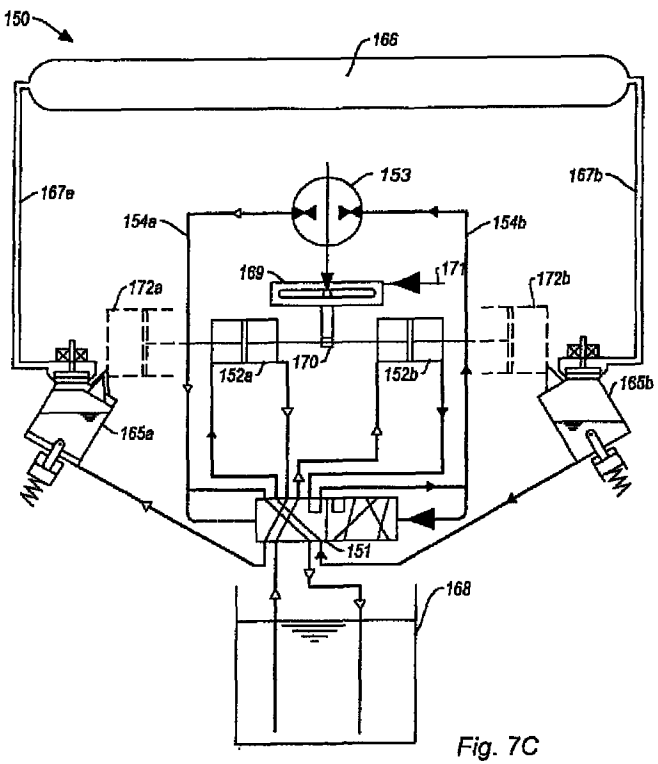
Figure 8:
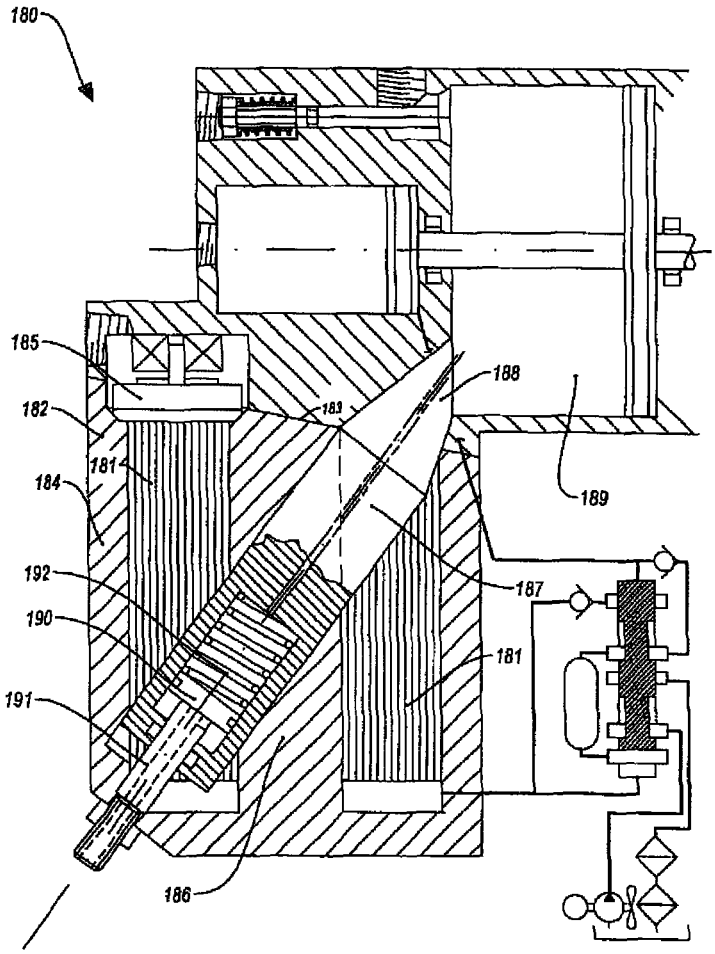

The invention will be described in more detail in the following with reference to the drawings. There are shown in these:

FIG. 1 a liquid piston arrangement with two liquid pistons, two hydrostatic regulated units and one low-pressure generator or expander;

FIGS. 2A to 2D the liquid piston arrangement from FIG. 1 during operation;

FIGS. 3A to 3D a liquid piston arrangement with a measurement piston as an entrainment of a low pressure piston during operation;

FIG. 4 a section through a stack of sheets from FIG. 3A;

FIG. 5 a liquid piston arrangement with two push-pull elements in compounded operation;

FIG. 6 the torque curve as a result of the compounded operation of the liquid piston arrangement of FIG. 5;

FIGS. 7A to 7D a liquid piston arrangement with a single diverter valve during operation; and FIG. 8 a part of a liquid piston arrangement with a heat exchanger coil.

The liquid piston arrangements described in the following and shown schematically in the Figures have liquid pistons which each contain a stack of sheets with fixed intervals between the sheets. The stack of sheets in particular fills up the whole rectangular working space of the liquid piston. The free surface of the liquid between the sheets in this respect embodies the piston. The stack of sheets is displaceable to move and guide the valve cone fastened to the upper stack side surface without any free space in the sheets, ensuring a tight connection between the low-pressure space and the high-pressure space. Consequently, no dead air space remains in the high-pressure space when the valve cone is closed. The stack of sheets takes up the heat arising during the work cycles. Since the stack of sheets is sequentially flowed around completely in every stroke, it remains approximately at the temperature of the liquid. The heat is released from the liquid to the environment via an external heat exchanger.

An embodiment provides that the rectangular high-pressure space is arranged obliquely, whereby the low-pressure valve cone can close the working space of a low-pressure piston with the high-pressure space free of dead volume in the closed state and the position of the high-pressure valve poppet at the upper corner of the stack of sheets enforces a funnel-like inflow on compression and thus prevents swirling transverse currents.

The liquid piston arrangements described here in particular prevent any dead space, making high-pressure heat exchangers superfluous and ensuring a timing precision adapted to the process.

The plate exchangers described in the following are inserted into a respective kinematic chain so that the losses shaft/air or current/air do not cancel out the achieved efficiency. In this respect, topological embodiments are provided which in particular avoid air inclusions through swirling and high accelerations and friction due to lateral forces and aging, and indeed by means of a harmonious intermeshing of the elements of the "liquid connecting rod".

The liquid piston arrangements shown in FIGS. 1 to 8 in particular satisfy one or more or even all of the following conditions:

1. The circuit should be leak-free in air, preferably by using poppet valves between the high-pressure cylinder and the low pressure space as well as at the pressure side to the storage, and should moreover remain completely free of dead space to avoid swirling and hot spots.
2. The integration of a low-pressure cylinder or of another low pressure generation should be provided since an uninterrupted compression/expansion from 1 bar to 200 bar would need big dimensions (this single-stage embodiment would, however, be absolutely possible thanks to a plate exchange effect).

3. A multiplication between the piston movement and the shaft rotation should be ensured since the stroke frequency will not exceed 1 to 2 Hz and the shaft should have at least 1500 r.p.m.
4. The multiplication of and the stroke movement should avoid solutions which cause transverse and large bearing forces (the roller element bearings would already be overstrained at modest power rates with the slow movements of the pistons for a given power).
5. To regenerate the liquid in operation, the connecting rod/piston volume should be periodically circulated without pressure via a sump so that bubbles, dust and moisture can be removed.
6. The external exchanger should be connected to the low-pressure side since the lowest possible temperature differences from the environment that are aimed for can barely be achieved with a reasonable effort and/or expense using high-pressure pipe exchangers. In addition, a single external exchanger can thus also serve multi-piston arrangements.
7. The piston stroke inversion should take place with small accelerations, in accordance with a predefined speed curve, which allows a smoothing of the pressure pulsations or torque pulsations in the compounded arrangements.
8. It should be prevented that, in solutions with pistons moving to and fro, a dead space arises which is not flushed through sufficiently in operation, thus storing contaminants and heat.

FIG. 1 schematically shows a liquid piston arrangement 1 for the quasi-isothermal compression and expansion of gases with two liquid pistons 2*a*, 2*b*. Due to the same design of the two liquid pistons 2*a*, 2*b*, the mutually corresponding elements of the liquid pistons 2*a*, 2*b*, such as the high-pressure spaces, stacks of sheets, etc., can be provided with ordinals ("first element" or "second element") such as is the case in the following claims. For reasons of clarity, however, the ordinals will be dispensed with in the description.

The liquid pistons 2*a*, 2*b* each include a high-pressure space 3*a*, 3*b* as well as a stack of sheets 4*a*, 4*b* supported in the high-pressure space 3*a*, 3*b*. The stacks of sheets 4*a*, 4*b* each comprise a plurality of metal sheets which are in particular arranged in parallel with one another. Furthermore, the metal sheets of a stack of sheets 4*a*, 4*b* can be arranged equidistantly and can in particular have a spacing between two adjacent metal sheets in the range of 0.3 to 0.8 mm. A liquid level 5*a*, 5*b* in the respective high-pressure spaces 3*a*, 3*b* between the metal sheets of the stack of sheets 4*a*, 4*b* embodies the respective piston.

The stacks of sheets 4*a*, 4*b* are displaceably supported in the high-pressure spaces 3*a*, 3*b* to subject the low-pressure valve cones 6*a*, 6*b* fastened to their upper sides for positive control, whereby low-pressure valves 7*a*, 7*b* are opened or closed. The lower side of the stack of sheets 4*a*, 4*b* are fastened to spring-loaded actuator pistons 8*a*, 8*b* by which the stacks of sheets 4*a*, 4*b* can be pushed into the high-pressure spaces 3*a*, 3*b*.

The liquid piston arrangement 1 furthermore includes a low-pressure generator or expander 10 which can e.g. be configured as a reversible scroll unit or as a turbine. The low-pressure generator or expander 10 is connected to the low-pressure valves 7*a*, 7*b* via an air line 11 to be able to introduce a low pressure in the high-pressure spaces 3*a*, 3*b*. The other duct of the low-pressure generator or expander 10 is equipped with a suction filter and/or a muffler 12. The low-pressure generator or expander 10 is mounted onto a shaft 13 and is driven by it.

Furthermore, two variable hydrostatic units 14*a* and 14*b* are provided which work in push-pull mode and which can likewise be driven by the shaft 13 or can drive the shaft 13 in motor operation. The hydrostatic units 14*a*, 14*b* are connected to the high-pressure spaces 3*a*, 3*b* via lines 15*a*, 15*b* so that the they can feed liquid into or remove liquid from the high-pressure spaces 3*a*, 3*b*. Furthermore, the hydrostatic unit 14*a* controls the actuator piston 8*b* via a line 16*a* and the hydrostatic unit 14*b* controls the actuator piston 8*a* via a line 16*b*. When the actuator pistons 8*a*, 8*b* are exposed to a high pressure via the lines 16*a*, 16*b*, they force the stacks of sheets 4*a*, 4*b* downwardly and thereby open the low-pressure valves 7*a*, 7*b*. In contrast, not pressurized lines 16*a*, 16*b* allow to close the low-pressure valves 7*a*, 7*b* due to the spring loading of the actuator pistons 8*a*, 8*b*.

A speed of rotation default signal 21 can be the input into an actuator 20 from which, together with the respective speed of rotation ω of the shaft 13 and the displacement volume setting a of the hydrostatic units 14*a*, 14*b*, the actuator 20 calculates the effective liquid infeed or liquid removal through the lines 15*a*, 15*b*, with the magnetic abutment of the respective high-pressure poppet valves 31*a*, 31*b* delivering the indispensable synchronization reset signal to the solenoid coil 33*a* or 33*b*.

As FIG. 1 shows, the hydrostatic units 14*a*, 14*b* are connected to a sump 22 via filters 23*a*, 23*b*, an external heat exchanger 24 and check valves 25.

High-pressure valves 30*a*, 30*b* are arranged together with the low-pressure valves 7*a*, 7*b* at the high-pressure spaces 3*a*, 3*b*. The high-pressure valves 30*a*, 30*b* comprise high-pressure valve poppets 31*a*, 31*b* which are arranged in cavities 32*a*, 32*b* and can be controlled by solenoid coils 33*a*, 33*b*. Connections from the high-pressure valves 30*a*, 30*b* to a storage space 35 are present via lines 34*a*, 34*b*.

The operation of the liquid piston arrangement 1 will be explained in the following with reference to FIGS. 2A to 2D, with two operating modes of the liquid piston arrangement 1 being distinguished. In a first operating mode which is shown schematically in FIGS. 2A and 2B, gas is compressed while applying energy. In a second operating mode, which is shown schematically in FIGS. 2C and 2D, the gas is expanded again and the energy released in this process is converted into a movement of the shaft 13.

In FIGS. 2A to 2D, as also in all other Figures, triangles symbolize the flow direction of the liquid in the respective lines. Shaded triangles characterize a high-pressure areas, non-shaded triangles characterize a low-pressure areas. Flowless lines are shown dashed.

Figure 2B:
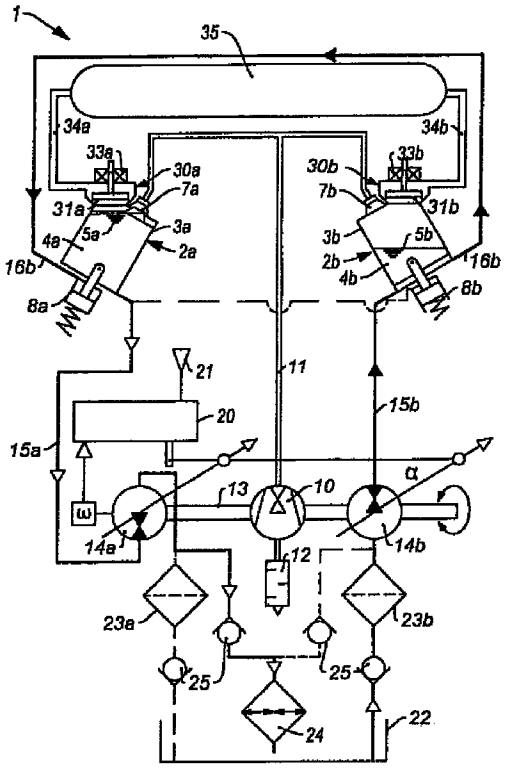
Figure 2A:
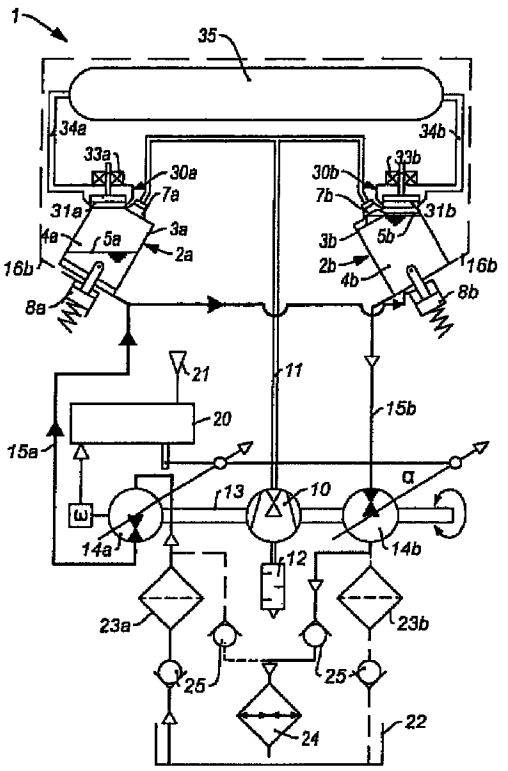

On the compression of the gas, for example air, shown in FIGS. 2A and 2B, a low pressure is first prepared in the respective high-pressure space 3*a*, 3*b* provided by the low-pressure generator or expander 10. This pressure is subsequently increased by the liquid that is pumped into the high-pressure space 3*a*, 3*b*. As soon as the pressure present in the storage space 35 is reached, the high-pressure valve 30*a*, 30*b* opens and a pressure increase in the storage space 35 can be achieved.

FIGS. 2A and 2B show the two positions of the stacks of sheets 4*a*, 4*b* controlled by the actuator pistons 8*a*, 8*b*. In FIG. 2A, the stack of sheets 4*a* is in the upper position, so that the low-pressure valve 7*a* is closed, whereas the stack of sheets 4*b* is in the lower position and the low-pressure valve 7*b* is accordingly opened. In FIG. 2B, the positions of the stacks of sheets 4*a*, 4*b* are inversed.

FIG. 2A shows that the hydrostatic unit 14*a* conveys liquid from the sump 22 via the filter 23*a* and pumps the liquid onward into the high-pressure space 3*a*, which has the consequence of an increasing liquid level 5*a* there. In the preceding working phase, a low pressure of e.g. 1 to 6 bar had been generated in the high-pressure space 3*a* by means of the low-pressure generator or expander 10. This pressure now successively increases due to the increasing liquid level 5*a*. As soon as the same pressure is present in the high-pressure space 3*a* as in the storage space 35, the high-pressure valve 30*a* opens and an infeed into the storage space 35 can take place.

At the same time, the liquid contained in the high-pressure space 3*b* is pumped by the hydrostatic unit 14*b* via the heat exchanger 24 into the sump 22. Since the low-pressure valve 7*b* is open, the low pressure generated by the low-pressure generator or expander 10 is present in the high-pressure space 3*b*.

Subsequently, the actuator pistons 8*a*, 8*b* are switched over so that the positions of the stacks of sheets 4*a*, 4*b* and thus of the low pressure valve cones 7*a*, 7*b* as shown in FIG. 2B result.

During the working phase shown in FIG. 2B, the liquid previously pumped into the high-pressure space 3*a* is pumped off again by the hydrostatic unit 14*a* and flows into the sump 22 via the heat exchanger 24. The low-pressure generator or expander 10 introduces the low pressure in the high-pressure space 3*a* via the opened low-pressure valve 7*a*.

In the meantime, the liquid level 5*b* rises in the high-pressure space 3*b* due to the liquid supplied from the sump 22 by the hydrostatic unit 14*b*. As soon as the pressure of the storage space 35 is reached in the high-pressure space 3*b*, the high-pressure valve 30*b* opens and the gas in the storage space 35 is further compressed.

The cycle comprising the two working phases shown in FIGS. 2A and 2B is then repeated, whereby a desired pressure can be generated in the storage space 35 in the range from, for example, 200 to 300 bar. The energy which was expended to generate this pressure can be converted into a movement of the shaft 13 working as a motor.

Figure 2D:
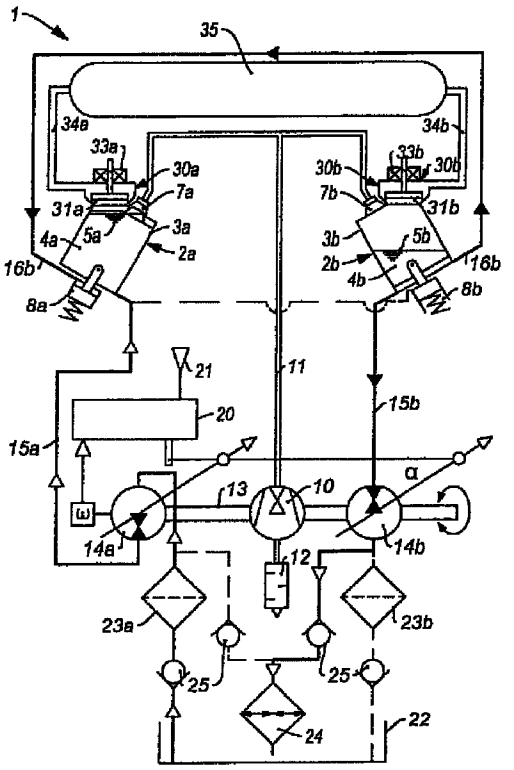
Figure 2C:
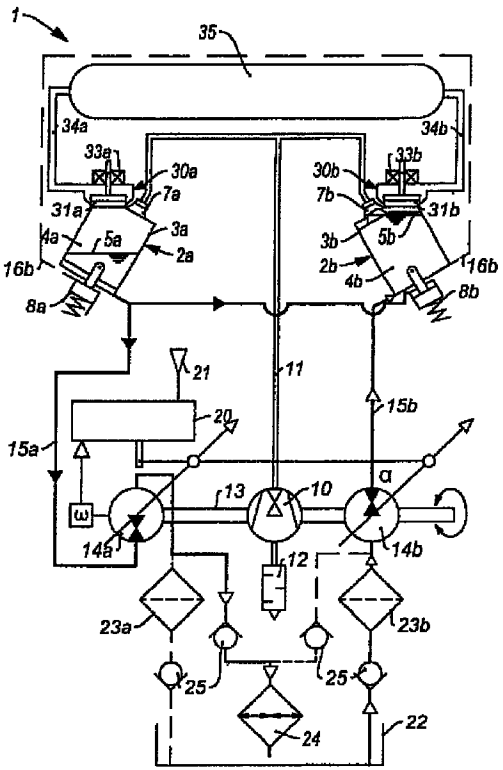

The two working phases of the motor operation are shown in FIGS. 2C and 2D. In FIG. 2C, the actuator piston 8*a* forces the stack of sheets 4*a* into the upper position, so that the low-pressure valve 7*a* is closed, whereas the stack of sheets 4*b* is in the lower position and the low-pressure valve 7*b* is accordingly opened. In FIG. 2D, the positions of the stacks of sheets 4*a*, 4*b* are inversed.

Steel disks are attached to the backs of the high-pressure valve poppet 31*a*, 31*b* by which steel disks the high-pressure valves 30*a*, 30*b* can be influenced with the aid of the solenoid coils 33*a*, 33*b*, so that the high-pressure valve poppet 31*a*, 31*b* are kept in the open position after the opening for the purpose of metering the needed volume in order to reach the desired low pressure after the expansion stroke by maintaining a current flow over the connector wires of the solenoid coils 33*a*, 33*b*.

In motor operation, the pressure previously stored in the storage space 35 can be supplied to the high-pressure spaces 3*a*, 3*b* by the direct opening and closing of the high-pressure valves 30*a*, 30*b*. As FIG. 2C shows, the shaft 13 is driven via the hydrostatic unit 14*a* by the high-pressure stored in the high-pressure space 3*a*. The liquid which is forced out of the high-pressure space 3*a* in this process flows via the hydrostatic unit 14*a* and the outer heat exchanger 24 into the sump 22. At the same time, the hydrostatic unit 14*b* pumps liquid out of the sump 22 into the high-pressure space 3*b* in which the low-pressure generator or expander 10 generates the low pressure via the opened low-pressure valve 7*b*. The energy which is expended to operate the hydrostatic unit 14*b* and the low-pressure generator or expander 10 in this respect ultimately comes from the energy which has been transferred to the shaft 13 by the hydrostatic unit 14*a*. Furthermore, further machines can be driven by the shaft 13, for example a generator for power generation.

During the working phase shown in FIG. 2D, the functionalities of the two liquid pistons 2*a*, 2*b* are exactly the reverse to FIG. 2C. A high pressure is introduced in the high pressure space 3*b* by the direct opening and closing of the high-pressure valve 30, said high pressure pressing back the liquid previously pumped into the high-pressure space 3*b* by the hydrostatic unit 14*b*. The hydrostatic unit 14*b* thereby converts a portion of the energy stored in the storage space 35 into a movement of the shaft 13. A portion of this energy is in turn used by the hydrostatic unit 14*a* and the low-pressure generator or expander 10 to pump liquid out of the sump 22 into the high-pressure space 3*a* and to generate the low pressure in the high-pressure space 3*a*. Subsequently, the cycle comprising the working phases shown in FIGS. 2C and 2D is repeated.

The stacks of sheets 4*a*, 4*b* in the high-pressure spaces 3*a*, 3*b* act as heat exchangers and also ensure an approximately isothermal operation in higher pressure ranges. The heat generated on the compression and expansion is transferred from the air onto the metal plates of the stacks of sheets 4*a*, 4*b* in the high-pressure spaces 3*a*, 3*b* and from them onto the liquid which flows alternatively around the stacks of sheets 4*a*, 4*b*. The heat is finally released from the liquid via an outer heat exchanger 24 to the environment.

The liquid piston arrangement 1 shown in FIG. 1 is a basic design of a push-pull circuit which satisfies all of the above-named conditions without a measurement piston; however, with two hydrostatic regulation units 14*a*, 14*b* and with the separate low-pressure generator or expander 10, which does not represent an optimum with respect to price and efficiency (in compounded operation there would be four hydrostatic units, but a single low-pressure generator or expander would be sufficient). All further liquid piston arrangements described in the following can be derived from this basic design.

FIG. 3A schematically shows a liquid piston arrangement 50 having two measurement pistons as drives of a low pressure piston, whereby a second hydrostatic unit and the low-pressure generator or expander become dispensable; however, with the aid of a reversing valve and a circulation pump in the low pressure circuit, as will be described in the following. Different operating modes of the liquid piston arrangement 50 are shown in FIGS. 3A to 3D.

In a similar manner as the liquid piston arrangement 1 of FIG. 1, the liquid piston arrangement 50 has two liquid pistons 51*a*, 51*b* which each include a high-pressure space 52*a*, 52*b* as well as a stack of sheets 53*a*, 53*b* supported in the high-pressure space 52*a*, 52*b*.

In the present embodiment, the stacks of sheets 53*a*, 53*b* comprise stacks of metal sheets which are displaceably supported in the longitudinal axis in the high-pressure spaces 52*a*, 52*b* by means of spring-loaded actuator pistons 54*a*, 54*b*. The movement of the stacks of sheets 53*a*, 53*b* determines the movement of low-pressure valve cones 55*a*, 55*b* and thus the opening and closing of low-pressure valves 56*a*, 56*b* since the low-pressure valve cones 55*a*, 55*b* are fixedly connected to the respective stack of sheets at the upper stack surface.

The sheet metal plates of the stacks of sheets 53*a*, 53*b* can be provided with a spacer nub 57*a*, 57*b* or other inlays by which the spacing between the sheet metal plates is defined.

The spacings between two respective adjacent sheet metal plates in the stacks of sheets 53*a*, 53*b* can in particular be constant. The sheet metal plates can be aligned in parallel with one another and the spacing between adjacent sheet metal plates in particular amounts to between 0.3 and 0.8 mm. The stacks of sheets 53*a*, 53*b* can have the form of a rectangular prism, as is schematically shown in FIG. 4, which shows a section of the stack of sheets 53*a* in the cylinder block 58*a* along the line A-A' drawn in FIG. 3A, i.e. a section perpendicular to the longitudinal axis of the stack of sheets 53*a*. The stacks of sheets 53*a*, 35*b* completely fill up the respective high-pressure space 52*a*, 52*b* perpendicular to the longitudinal axis, i.e. in the plane shown in FIG. 4.

The low-pressure valves 56*a*, 56*b* analogously connect the low pressure spaces 59*a*, 59*b* of the low pressure piston 60 to the respective high-pressure spaces 52*a*, 52*b*. The cylinder blocks 58*a*, 58*b* in which the respective high-pressure spaces 52*a*, 52*b* are located also include the seat of the high-pressure valve poppets 65*a*, 65*b* of the high-pressure valves 66*a*, 66*b*. The high-pressure valve poppets 65*a*, 65*b* are arranged together with holding solenoid coils 68*a*, 68*b* in respective cavities 67*a*, 67*b* and are coaxially guided thereby.

The respective liquid piston level 70*a*, 70*b* is moved by a measurement piston 72*a*, 72*b* which is coupled to the liquid duct 71*a*, 71*b* and which also takes along the low pressure piston 60 (the measuring pistons 72*a*, 72*b* and the low pressure piston 60 are connected to one another via a rod) and forces a complete flowing around of the respective stack of sheets 53*a*, 53*b* on every stroke and thus an indirect exchange with an external heat exchanger 75. This flow flows through a 7/2 way diverter valve 76*a*, 76*b* which serves a pressure-less circuit with the external heat exchanger 75, a filter 77 and a sump container 78. This arrangement allows an exhaustive exchange of the piston liquid on every stroke since, depending on the direction of flow, the liquid flows either directly from the stack of sheets 53*a*—as shown by way of example on the left hand side in FIG. 3A—to the measurement piston 72*a* via an exchange volume 80*a* and a check valve 81*a*, on a movement of the measurement piston 72*a* to the left (low-pressure compression), in accordance with the shown spool position of the 7/2 way diverter valve, or with a high-pressure compression—as shown by way of example on the right hand side in FIG. 3B—from the measurement piston 72*b* back into the high-pressure space 52*b* via a check valve 82*b*, wherein the spool of the 7/2 way diverter valve 76*b* is pushed into the pressure-side blocking position for the exchange volume 80*b* and a pump 85 can herewith circulate the liquid of the exchange volume 80*b* thanks to the opening of the corresponding ports during this stroke (the circulation of the liquid contained in one of the exchange volumes 80*a*, 80*b* by means of the pump 85 is shown by triangles filled with dashed lines in FIGS. 3A to 3D).

In the working phase shown in FIG. 3A, an intake/outlet valve 86*a* arranged free of dead space at the low pressure space 59*a* is closed to generate the required low pressure in the low pressure space 59*a*. At the same time, an intake/outlet valve 86*b* arranged without dead space at the low pressure space 59*b* is opened so that a pressure compensation with the environment can take place in the low pressure space 59*b*. The intake/outlet valves 86*a*, 86*b* are each opened and closed by means of an actuator piston.

The measurement pistons 72*a*, 72*b* are inserted into the respective hydraulic path between the controllable hydrostatic unit 87 and the 7/2 way diverter valve 76*a*, 76*b* and thus obey the mechanically or electronically active modified sine speed profiles which limit the acceleration of the liquid piston levels 70*a*, 70*b*.

The operating liquid should preferably have a very small steam pressure, such as water or an ionic liquid from the methylimidazolium group and in particular the hydrophobic ionic liquid 1-ethyl-3-methylimidazolium bis(trifluoromethylsulfonyl)amide (EMIM BTA) since the solubility of air under pressure is hereby minimized and the condensed water is separated without problem.

Since in the topology shown in FIG. 3A (pseudo two-stage system without any intermediate pressure space) the high-pressure spaces 53*a*, 53*b* always remain under pressure (with low-pressure compression or expansion between 1 bar and the volume ratio of the low-pressure space 59*a*, 59*b* to high-pressure space 53*a*, 53*b*, with high-pressure compression or expansion between just this ratio and the storage pressure), the circulation by means of a diverter valve is practically unavoidable (except for the solution with two hydrostatic units) since otherwise an enclosed volume would oscillate to and fro without a venting and purification possibility and with a heat exchange only through the wall of high-pressure pipes, which is a disadvantage of multi-stage, part-adiabatic compressors.

The pseudo-two-stage system selected here simplifies the valve technology decisively since only the high-pressure valves 66*a*, 66*b* have to be controlled in dependence on a plurality of operating parameters in motor operation, whereas the switching of the low-pressure valves 56*a*, 56*b* via the actuator pistons 54*a*, 54*b* is initiated synchronously with the respective intake/outlet valve 86*a*, 86*b* via its control piston by the reversal of direction of the measurement piston 72*a*, 72*b* or by the reversal of the flow of a hydrostatic unit 87 at the dead centers. Very high pressures can therefore be managed using this arrangement with only two "pseudo" stages (with a small low stage of 5 to 6 bar and the main stage of 200 to 300 bar, with the respective stack of sheets 53*a*, 53*b* always remaining in connection with both working spaces), which means a striking improvement in efficiency over the standard 4-piston or 5-piston machines.

The hydrostatic unit 87 is controlled by an actuator unit 88 which is in turn controlled by software running on a processor 89 or on another computing unit.

The high-pressure valve poppets 65*a*, 65*b* satisfy a complex task, in particular in the case of motor operation, as here the cut-off point is not bound to the dead centers and has to be determined by means of a computer and sensors in the case of a motor. Working with a liquid piston allows the fixing of the top dead center of the respective measurement piston 72*a*, 72*b* beyond the poppet seat plane; the liquid will only flow around the high-pressure valve poppet 65*a*, 65*b* and partly fill up the cavity 67*a*, 67*b*. The closing of the respective high-pressure valve flap 65*a*, 65*b* must be delayed so that the liquid piston level 70*a*, 70*b* can pass through the seat plane exactly at that moment in which the high-pressure poppet 65*a*, 65*b* hits its seat. A compressor operation free of dead volume is thus ensured which can be realized in a technically relatively simple manner in that the high-pressure poppets 65*a*, 65*b* are designed as floatable, which automatically brings about the desired delay. The situation is different in motor operation as here the passage must remain open for some time after the opening of the respective high-pressure poppets 65*a*, 65*b* which is initiated by maintaining a passage once the liquid piston level 70*a*, 70*b* has passed the seat plane. This is achieved by making the steel plate which is attached to the back of the respective high-pressure poppet 65*a*, 65*b* stick magnetically to the holder solenoid abutment after the opening in order to hold the high-pressure poppet 65*a*, 65*b* in the open position as long as a current is applied to the connecting wires of the solenoid coil 68*a*, 68*b*. The control of the solenoid coils 68*a*, 68*b* is carried out by a control unit, for example by the processor 89.

While other types of valve actuation are conceivable at this point, the approach using the holder solenoids additionally allows the exact detection of the opening point in time thanks to the change in the coil current at the moment of the abutment of the steel disk at the respective solenoid coil 68*a*, 68*b* which can serve as a signal for the purpose of an exact determination of the active liquid surplus and of a corresponding control, and indeed via the measurement of the time duration between the abutment and the dead center. In addition, this solution is energetically extremely efficient despite fast valve closing. These advantages are, however, acquired by the necessity of carrying out some compressor strokes on start-up before the motor operation is initiated.

Figure 3B:
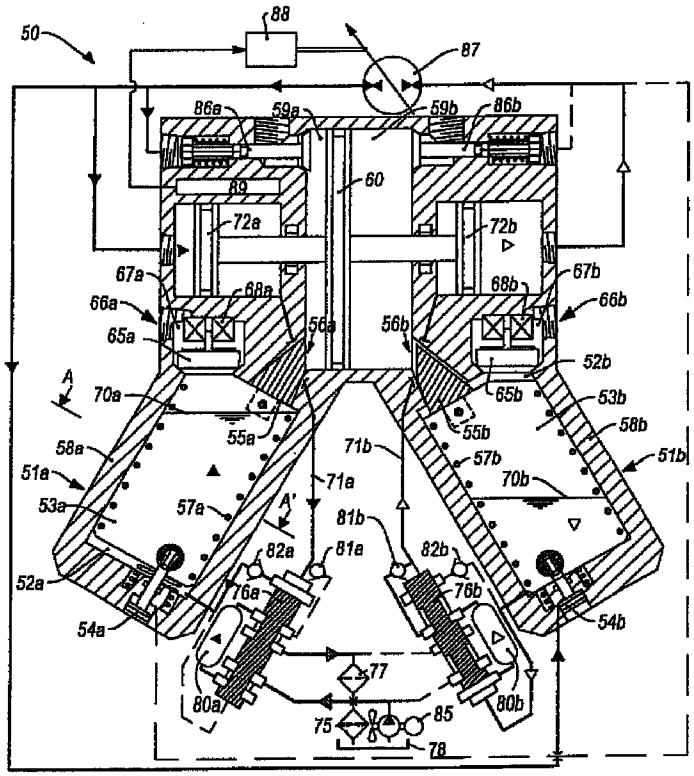

While it is shown in FIG. 3A how a high pressure is produced in the high-pressure space 53*b*, the high-pressure compression of the gas in the high-pressure space 52*a* is shown in FIG. 3B (the storage space in which the compressed gas is stored is not shown in FIGS. 3A to 3D for reasons of clarity; however, the threaded ports for the storage space at the high-pressure valves 66*a*, 66*b* are shown). During the working phase shown in FIG. 3B, the actuator pistons 54*a*, 54*b* are controlled such that the low-pressure valve 56*a* is closed, i.e. the stack of sheets 53*a* is located in the upper position, and the low-pressure valve 56*b* is open, i.e. the stack of sheets 53*b* is located in the lower position. The liquid located in the right-hand chamber of the measurement piston 72*a* is pumped from the hydrostatic unit 87 via the check valve 82*a* into the high-pressure space 52*a*, whereby a high air pressure is produced. At the same time, the liquid located in the high-pressure space 52*b* is conveyed via the 7/2 way diverter valve 76*b* and the check valve 81*b* into the left hand chamber of the measurement piston 72*b*.

In the working phase shown in FIG. 3B, the intake/outlet valve 86*a* is opened so that a pressure compensation with the environment can take place in the low pressure space 59*a*. At the same time, the intake/outlet valve 86*b* is closed to generate the required low pressure in the space 59*b*.

The liquid located in the exchange volume 80*a* is circulated by the pump 85 in FIG. 3B. In this respect, for example, the exchange volume 80*a* is emptied into the sump 78 and fresh liquid is pumped from the sump 78 into the exchange volume 80*a*.

Figure 3C:
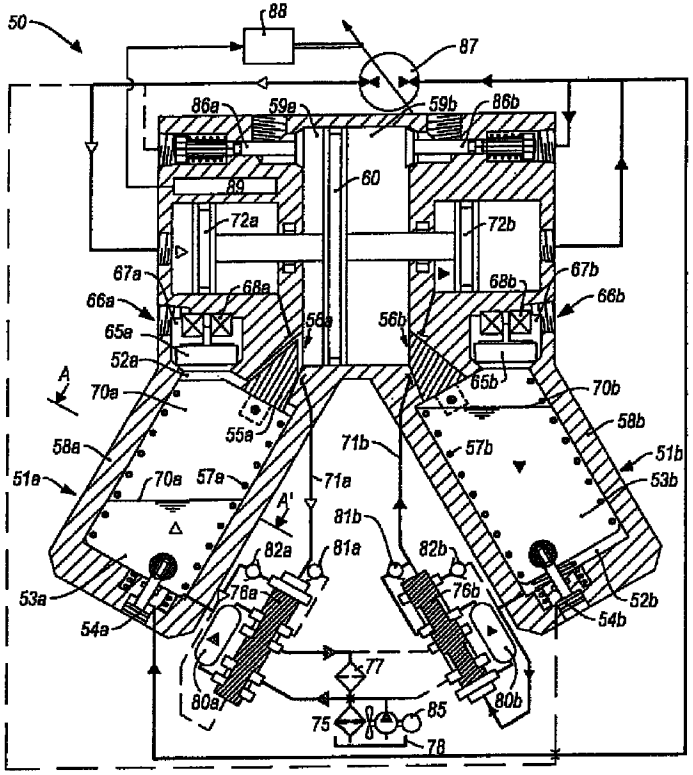
Figure 3D:
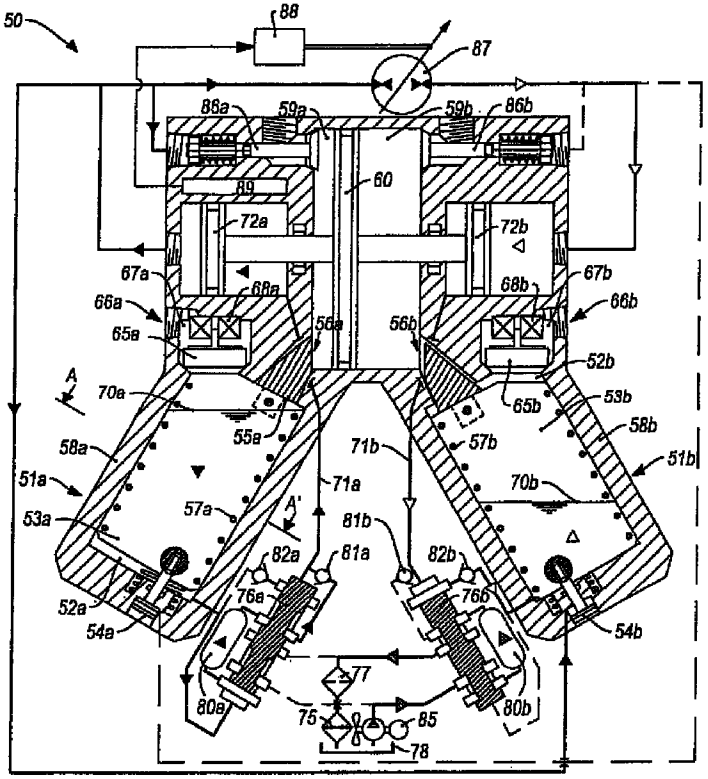

FIGS. 3C and 3D show the two working phases on the expansion of the gas, i.e. on motor operation, in which the energy stored in the compressed gas is converted by the hydrostatic unit 87 or by units connected thereto into other forms of energy, e.g. electrical energy or mechanical work.

FIG. 3C shows a working phase in which the low-pressure valve 56*a* is opened and the low-pressure valve 56*b* is closed. Furthermore, the intake/outlet valves 86*a*, 86*b* are closed or opened respectively. The high-pressure space 52*b* initially filled with the liquid is acted on by the pressure present in the storage space via the opened high-pressure valve 66*b*. Liquid is thereby conducted from the high-pressure space 52*b* via the 7/2 way diverter valve 76*b*, the exchange volume 80*b* and the check valve 81*b* into the left hand chamber of the measurement piston 72*b*. The measurement piston 72*b* thus moves to the right and drives the hydrostatic unit 87.

The liquid is pumped from the right hand chamber of the measurement piston 72*a* into the high-pressure space 52*a* via the 7/2 way diverter valve 76*a* and the check valve 82*a* by the solid coupling of the measurement piston 72*a* to the measurement piston 72*b* and the low pressure is produced in said high-pressure space via the opened low-pressure valve 56*a* by means of the low pressure piston 60 likewise coupled to the measurement piston 72*b*.

The liquid located in the exchange volume 80*a* is circulated by the pump 85 in FIG. 3C through the sump.

The second working phase in motor operation is shown in FIG. 3D. The low-pressure valve 56*a* is closed here and the low-pressure valve 56*b* is opened. Furthermore, the intake/outlet valves 86*a*, 86*b* are opened or closed respectively. The high-pressure space 52*a* initially filled with liquid is acted on by the pressure present in the storage space via the opened high-pressure valve 66*a*. Liquid is thereby pressed from the high-pressure space 52*a* via the 7/2 way diverter valve 76*a*, the exchange volume 80*a* and the check valve 81*a* into the right hand chamber of the measurement piston 72*a*. The measurement piston 72*a* thus moves to the left and drives the hydrostatic unit 87.

The liquid is pumped from the left hand chamber of the measurement piston 72*b* into the high-pressure space 52*b* via the check valve 82*b* by the solid coupling of the measurement piston 72*b* to the measurement piston 72*a* and the low pressure is produced in said high-pressure space via the opened low-pressure valve 56*b* by means of the low pressure piston 60 likewise coupled to the measurement piston 72*a*.

The liquid located in the exchange volume 80*b* is circulated by the pump 85 in FIG. 3D through the sump 78.

Subsequently, the cycle as shown in FIGS. 3C and 3D is repeated.

The simplicity of the basic circuit shown in FIG. 1 is obtained by the complexity of the detection of the stroke extent and by the additional use of a hydrostatic unit together with a low-pressure generator or expander, which can bring about price and efficiency disadvantages, although in larger plants which are composed of a number of high-pressure liquid piston spaces in parallel strands, a single low pressure apparatus can serve all strands. In this respect, the push-pull element with simple measurement pistons shown in FIG. 3A is rather suitable for small systems since only two hydro-diverters, two measurement pistons having interposed the low pressure piston and a circulation pump have to be added to the two liquid pistons to form an autonomous push-pull element which becomes a low-pulsation compounded unit by doubling.

Although the use of a single piston construction in accordance with FIG. 1 can at least be sensible for compression purposes, a liquid piston arrangement 100 having four liquid pistons, such as is shown schematically in FIG. 5, is recommended for motor purposes (expansion operation). The four pistons allow a compact speed-controllable unit with low torque pulsations whose characteristics are didactically disclosed in the diagram shown in FIG. 6.

The liquid piston arrangement 100 includes two push-pull elements 101 and 101' having measurement pistons 102*a*, 102*b*, 102*a*', 102*b*' which are hydraulically connected crosswise to a respective one variable hydrostatic unit 103, 103' at a common shaft 115. Each of the push-pull elements 101, 101' includes two liquid pistons which are operated in push-pull mode. The push-pull elements 101, 101' produce a displacement curve $Q_{(V1)}+Q_{(V2)}$ corresponding to a slightly modified sine curve and shown in FIG. 6 by feedback of the displacement adjustments 104, 104' to the measurement piston stroke. The two displacement curves $Q_{(V1)}$ and $Q_{(V2)}$ are mutually displaced by half a stroke in a push-pull mode. The single torque of the respective unit $M_{(V1)}$, $M_{(V2)}$ arise accordingly via the pressure application $p_{(V)}$ of the displacement and the torque curve M by the sum of the displaced individual torques. We can therefore see that the hyperbolic pressure peak, which represents a known obstacle in compressed air drives, can be "filtered out" by the displacement curve $Q_{(V)}$.

FIG. 5 additionally shows the versatility of the diverter valve concept with the arrangement of a single regeneration unit 105 in connection with the respective diverter valve housings 106, 106' and the exchange volumes 107, 107' at the four liquid piston housings 108*a*, 108*b*, 108*a'*, 108*b'*.

The liquid piston arrangement 100 is additionally suitable to explain the speed regulation from the pressure source, with the torque over the load determining the speed in motor drives using purely mechanical members, and indeed with the aid of steam machine linkages: The displacement curve $Q_{(V)}$ of FIG. 6 is determined by scanning a cam profile 110 which is transmitted to the motion link 112 by the movement of the piston rod 111, with the amplitude of the transmission onto the displacement adjustment 104 resulting by the vertical setting of the track engagement of the rod 113 by means of a screw hand wheel 114. The curve $Q_{(V)}$ can thus be modulated up to the reversal of the direction of rotation as soon as the vertical setting passes over the point of rotation of the motion link 112.

FIG. 7A schematically shows a liquid piston arrangement 150 with an enhanced diverter valve concept. The liquid piston arrangement 150 is managed with only one diverter valve 151 which controls two measurement pistons 152*a*, 152*b* of this push-pull element, and indeed in dependence on the pressure difference at the hydrostatic unit 153 which occurs between the lines 154*a*, 154*b* and acts on the diverter valve 151.

The further elements of this simplified measurement piston push-pull element are two liquid pistons 165*a*, 165*b* having valves and control pistons as well as a storage space 166. Connection lines 167*a*, 167*b* lead from the liquid pistons 165*a*, 165*b* to the storage space 166. A sump 168 is provided as a regeneration unit with a filter and heat exchanger, with no circulation pump being required here. A processor actuator 169 moves the displacement adjustment of the hydrostatic unit 153 in dependence on the feedback 170 of the piston position and the desired value input 171, with the possibility of a direct coupling of low pressure pistons 172*a*, 172*b* being indicated by dashed lines.

Different operating modes of the liquid piston arrangement 150 are shown in FIGS. 7A to 7D, with FIGS. 7A and 7B showing the compression of the gas using energy and FIGS. 7C and 7D showing the expansion of the gas.

In the first position of the diverter valve 151 shown in FIG. 7A, the hydrostatic unit 153 pumps liquid into the left hand chamber of the measurement piston 152*a*. The right hand chamber of the measurement piston 152*a* is emptied into the sump 168. Furthermore, the liquid is pumped out of the right hand chamber of the measurement piston 152*b* into the liquid piston 165*a*. The liquid piston 165*b* is emptied. In this respect, the air in the liquid piston 165*a* is compressed until the pressure is high enough that the high-pressure valve of the liquid piston 165*a* opens.

The second position of the diverter valve 151 is shown in FIG. 7B. Here, the hydrostatic unit 153 pumps liquid into the right hand chamber of the measurement piston 152*b* and the left hand chamber of the measurement piston 152*b* is emptied into the sump 168. The measurement piston 152*a* pumps liquid into the liquid piston 165*b* while the liquid piston 165*a* is being emptied. The pressure in the storage space 166 is thereby increased via the liquid piston 165*b*.

In motor operation, i.e. in the expansion of the gas contained in the storage space 166, liquid from the liquid piston 165*b* is pumped by the pressure of the gas out of the storage space 166 into the left hand chamber of the measurement piston 152*a* in the position of the diverter valve 151 shown in FIG. 7C. The liquid is pumped out of the right hand chamber of the measurement piston 152*a* into the liquid piston 165*a*. Since the two measurement pistons 152*a* and 152*b* are coupled to one another, the measurement piston 152*b* drives the hydrostatic unit 153 and the shaft connected thereto via its right hand chamber.

The functionalities are inverted over in the position of the diverter valves shown in FIG. 7D. The liquid piston 165*a* transmits the high pressure from the storage space 166 onto the measurement piston 152*b*, whereby the measurement piston 152*a* drives the hydrostatic unit 153 which converts the energy into a movement of the shaft.

In the present description, all the shaft/liquid converters are shown with good reason as reversible hydrostatic 4-quadrant units since the stroke profile can thus be defined with low loss. This does not preclude other drive solutions; however, the known solutions are subject to problems. For example, the mechanical arrangement with connecting rod and piston thus fails—although it has a fairly useful stroke profile with deceleration at the stroke ends—due to the bearing forces which occur at higher power and low speeds, not to mention the reduction gears required for this purpose.

Furthermore, the exchange piston working space in FIGS. 1 to 7 is shown only as a tilted rectangular prism for receiving the stack of sheets, with the high-pressure valve at the topmost tip. Other solutions are also conceivable here, e.g. as a coil such as described in the following. However, the funnel effect of the tilted rectangular prism has the most favorable behavior with respect to the stability of the liquid level on fast movements.

FIG. 8 schematically shows a part of a liquid piston arrangement 180 with a (heat) exchanger sheet coil 181 as an alternative to the rectangular prism. The exchanger coil 181 comprises a piece of sheet metal rolled together. The coil 181 is let into the cylinder body 182 whose oblique joint 183 with the piston block 184 produces a funneling convergence toward the high-pressure valve 185, in a similar manner as with the prismatic stack of sheets 53*a*, 53*b* of FIG. 3A. The coil 181 is in this respect wound around a cylinder body 186 of the piston block 184. The coil 181 together with the cylinder body 186 is penetrated laterally from bottom to top by a pin-shaped seat valve body 187 so that the connection between the low pressure space 189 and the liquid piston space in the coil 181 can be connected via a cone 188.

A connection free of dead volume is possible by means of the coil 181 without a movement of the sheet metal exchanger. Instead of the sheet metal exchanger, here the cone 188 is moved to open or close the connection between the low pressure space 189 and the liquid piston space in the coil 181. The movement of the cone 188 takes place by an action on a actuator piston 190 via a connector nipple 191, whereby a holding spring 192 is compressed.

Otherwise the elements already known from FIG. 3A are provided in FIG. 8 such as the intake/outlet valve, measurement piston, low pressure piston, hydro-diverter, etc., which ensure a smooth operation. The coil part together with the control valves can naturally also be operated without a measurement piston; in the sense of FIG. 1 with a separate low-pressure generator or expander. The exchanger coil 181 together with control valves shown in FIG. 8 can also be inserted into the liquid piston arrangements shown in FIGS. 1, 3, 5 and 7.

Finally, it must be emphasized that complex mechanics with non-friction cooperating members which are intimately intermeshed in function is required for all elements transformating the isothermal liquid piston into a rotary movement.

In summary, it can be stated that the indirect heat exchanger consists of sheet metal plates having fine and fixed intervals between the metal sheets and is inserted into push-pull circuits with adjustable hydrostatic units for the purpose of a low-loss kinetic transmission with a fast running shaft. In this respect, the rigorous cyclic replacement of the liquid has to be respected so that an ideal heat dissipation with uninterrupted regeneration (degassing, decanting, water separation) in a pressureless sump becomes possible. Various construction types of push-pull elements are possible (with two hydrostatic units and external low pressure generation, with diverter valves and measurement pistons for the purpose of moving a low pressure piston, with a single central diverter valve for both measurement pistons and combinations of these variants), with a combination of two phase-shifted push-pull elements making a low-pulsation unit possible which, as a flywheel-less air to shaft transformer with variable speed together with a high-pressure storage cavities represents a flexible energy storage which has the advantage with respect to electrochemical batteries of being able to directly drive machines or vehicles from a shaft.

The invention claimed is:

1. A liquid piston arrangement for compressing and expanding gases, comprising a first liquid piston which is embodied by a first liquid level formed by a liquid in a first high-pressure space; and a first stack of sheets with mutually spaced apart sheet metal plates which is supported in the first high-pressure space and is flowed around sequentially by the liquid, wherein a low-pressure valve cone is fastened to the first stack of sheets; and the first stack of sheets is displaceably supported in the first high-pressure space to subject the low-pressure valve cone to positively control and thereby to selectively open or close a low-pressure valve.

2. A liquid piston arrangement in accordance with claim 1, wherein the sheet metal plates are aligned in the direction of flow of the liquid.

3. A liquid piston arrangement in accordance with claim 1, further comprising a low pressure space which is connected to the low-pressure valve; and a low pressure piston supported in the low pressure space for generating a low pressure.

4. A liquid piston arrangement in accordance with claim 3, further comprising a measurement piston which selectively removes liquid from the high-pressure space or supplies it to the high-pressure space, wherein the measurement piston is connected to the low pressure piston via a rod.

5. A liquid piston arrangement in accordance with claim 4, further comprising a diverter valve which connects an exchange volume between the first high-pressure space and the measurement piston in a first position and connects the exchange volume to a storage container in a second position.

6. A liquid piston arrangement in accordance claim 3, further comprising an intake/outlet valve for connecting the low pressure space to the environment, wherein the intake/outlet valve is let into a wall of the low pressure space free of dead space.

7. A liquid piston arrangement in accordance with claim 1, further comprising a scroll displacer, screw displacer or turbine connected to the low-pressure valve for generating a low pressure.

8. A liquid piston arrangement in accordance with claim 1, further comprising a second liquid piston which is embodied by a second liquid level formed by the liquid in a second high-pressure space; and a second stack of sheets with mutually spaced apart sheet metal plates which is supported in the second high-pressure space and is sequentially flowed around by the liquid, wherein the first liquid piston and the second liquid piston are operated in a push-pull mode during the operation of the liquid piston arrangement.

9. A liquid piston arrangement in accordance with claim 8, further comprising exactly one diverter valve for controlling the first liquid piston and the second liquid piston.

10. A liquid piston arrangement in accordance with claim 1, further comprising a high-pressure valve arranged at the upper end of the first high-pressure space, wherein a high-pressure valve poppet of the high-pressure valve is designed as floatable.

11. A liquid piston arrangement in accordance with claim 10, further comprising a steel disk fastened to the back of the high-pressure valve poppet; and a solenoid coil which is designed such that the steel disk attached to the back of the high-pressure valve poppet contacts the holder solenoid formed by means of the solenoid coil after the opening and the holding force holds the high-pressure valve poppet in the open position.

12. A liquid piston arrangement in accordance with claim 11, wherein the solenoid coil serves as a signal transducer for the opening timing the high-pressure valve.

13. A liquid piston arrangement in accordance with claim 1, wherein the first high-pressure space is arranged tilted relative to the perpendicular; and the first high-pressure space converges in a funnel-like manner at the upper end.

14. A liquid piston arrangement in accordance with claim 1, wherein the liquid is an ionic liquid of the methylimidazolium group.

15. A liquid piston arrangement in accordance with claim 1, further comprising a spring-loaded piston which is connected to the first stack of sheets and is configured to displace the first stack of sheets.

16. A method of compressing and expanding gases, wherein a gas is compressed or expanded by means of a liquid piston in a high-pressure space;

the liquid level of a liquid in the high-pressure space embodies the liquid piston;

a stack of sheets with mutually spaced apart sheet metal plates is supported in the high-pressure space and is sequentially flowed around by the liquid, wherein a low-pressure valve cone is fastened to the stack of sheets; and the stack of sheets is displaced in the first high-pressure space to subject the low-pressure valve cone to positively control and thereby to selectively open or close a low-pressure valve.

17. A liquid piston arrangement for compressing and expanding gases, comprising a liquid piston which is embodied by a liquid level formed by a liquid in a high-pressure space; and a high-pressure valve arranged at the upper end of the high-pressure space, wherein a high-pressure poppet valve of the high-pressure valve is designed as floatable.

18. A liquid piston arrangement for compressing and expanding gases, comprising a liquid piston which is embodied by a liquid level formed by a liquid in a high-pressure space;

coil which is supported in the high-pressure space as a heat exchanger and is Sequentially flowed around by the liquid;

a low-pressure valve cone for connecting the high-pressure space to a low-pressure space; and a control of the low-pressure valve cone which extends through the high-pressure space.

19. A liquid piston arrangement for compressing and expanding gases, comprising a first push-pull element which has a first liquid piston and a second liquid piston, wherein the first and the second liquid pistons are operated in push-pull mode; and a second push-pull element which has a third liquid piston and a fourth liquid piston, wherein the third and the fourth liquid pistons are operated in push-pull mode, wherein the liquid pistons are each embodied by a liquid level formed by a liquid in a respective high-pressure space;

the first push-pull element and the second push-pull element are operated in a phase shifted manner;

a first hydrostatic unit which is connected to the first push-pull element;

a second hydrostatic unit which is connected to the second push-pull element; and a common shaft which is connected to the first and second hydrostatic units.

20. A liquid piston arrangement in accordance with claim 19, wherein the first push-pull element and the second push-pull element are operated with a phase shift of 90°.

* * * * *